US011263990B2

(12) United States Patent
Liu et al.

(10) Patent No.: US 11,263,990 B2
(45) Date of Patent: Mar. 1, 2022

(54) METHOD AND DEVICE FOR ADJUSTING DISPLAY PANEL, AND DISPLAY DEVICE

(71) Applicants: BOE TECHNOLOGY GROUP CO., LTD., Beijing (CN); HEFEI XINSHENG OPTOELECTRONICS TECHNOLOGY CO., LTD., Anhui (CN)

(72) Inventors: Yuanyuan Liu, Beijing (CN); Min Wang, Beijing (CN); Rui Ma, Beijing (CN)

(73) Assignees: BOE TECHNOLOGY GROUP CO., LTD., Beijing (CN); HEFEI XINSHENG OPTOELECTRONICS TECHNOLOGY CO., LTD., Anhui (CN)

( * ) Notice: Subject to any disclaimer, the term of this patent is extended or adjusted under 35 U.S.C. 154(b) by 955 days.

(21) Appl. No.: 15/777,775

(22) PCT Filed: Oct. 17, 2017

(86) PCT No.: PCT/CN2017/106527
§ 371 (c)(1),
(2) Date: May 21, 2018

(87) PCT Pub. No.: WO2018/153109
PCT Pub. Date: Aug. 30, 2018

(65) Prior Publication Data

US 2021/0210042 A1 Jul. 8, 2021

(30) Foreign Application Priority Data

Feb. 24, 2017 (CN) ..... 201710105796.0

(51) Int. Cl.
*G09G 3/36* (2006.01)
*G09G 3/00* (2006.01)

(52) U.S. Cl.
CPC ..... *G09G 3/3696* (2013.01); *G09G 3/006* (2013.01); *G09G 3/3614* (2013.01); *G09G 3/3688* (2013.01); *G09G 2320/0247* (2013.01)

(58) Field of Classification Search
CPC .... G09G 3/3696; G09G 3/006; G09G 3/3614; G09G 3/3688; G09G 2320/0247;
(Continued)

(56) References Cited

U.S. PATENT DOCUMENTS 6,618,774 B1 * 9/2003 Dickens ..... G06F 13/385 174/19
2001/0004253 A1 * 6/2001 Fukutoku ..... G09G 3/3614 345/96

(Continued)

FOREIGN PATENT DOCUMENTS

CN 1928643 A 3/2007
CN 101141141 A 3/2008

(Continued)

OTHER PUBLICATIONS

Office Action dated Dec. 3, 2018 issued in corresponding Chinese Application No. 201710105796.0.

(Continued)

*Primary Examiner* — Kent W Chang
*Assistant Examiner* — Sujit Shah
(74) *Attorney, Agent, or Firm* — Nath, Goldberg & Meyer; Joshua B. Goldberg

(57) ABSTRACT

The present disclosure discloses a method for adjusting a display panel, a device for adjusting a display panel, and a display device including the adjusting device. The method includes: detecting an image displayed by a display panel to determine whether the displayed image is a flickering image; inverting original polarities of data voltages inputted onto at least partial data lines of the display panel when it is detected (Continued)

that the displayed image is the flickering image; scanning an I2C interface, and determining whether a common voltage is written; and restoring the polarities of the data voltages on the at least partial data lines to the original polarities when it is determined that the common voltage is written via the I2C interface.

11 Claims, 4 Drawing Sheets

(58) Field of Classification Search
CPC ..... G09G 3/3677; G09G 2300/0426; G02F 1/1368; G02F 1/136286
USPC ..... 345/55
See application file for complete search history.

(56) References Cited

U.S. PATENT DOCUMENTS

2007/0290980 A1* 12/2007 Lin ..... G09G 3/3688 345/100
2010/0156885 A1* 6/2010 Cho ..... G09G 3/006 345/214
2016/0232863 A1* 8/2016 Yamagishi ..... G09G 3/3659

FOREIGN PATENT DOCUMENTS

| | | | |
|---|---|---|---|
| CN | 102693702 | A | 9/2012 |
| CN | 104680961 | A | 6/2015 |
| CN | 106847213 | A | 6/2017 |
| EP | 0351253 | A2 | 1/1990 |
| JP | 2004-45741 | A | 2/2004 |
| JP | 2004045741 | A | 2/2004 |
| TW | 200811793 | A | 3/2008 |

OTHER PUBLICATIONS

Design and Confirmation of Flicker Automatic Adjustment Tool, Dec. 31, 2015.
International search report dated Jan. 4, 2018 for corresponding application No. PCT/CN2017/106527 with English translation attached.
"Design and Conformation for Flicker Automatic Adjustment Tool", Dec. 31, 2015.

* cited by examiner

METHOD AND DEVICE FOR ADJUSTING DISPLAY PANEL, AND DISPLAY DEVICE

This is a National Phase Application filed under 35 U.S.C. 371 as a national stage of PCT/CN2017/106527, filed Oct. 17, 2017, an application claiming the benefit of Chinese Application No. 201710105796, filed Feb. 24, 2017, the content of each of which is hereby incorporated by reference in its entirety.

TECHNICAL FIELD

The present disclosure relates to a field of display technology, in particular, to a method for adjusting a display panel, a device for adjusting a display panel, and a display device.

BACKGROUND

As for a thin-film-transistor liquid-crystal display (referred to TFT-LCD as simply), there are two typical methods for adjusting an image flicker of a liquid crystal display panel as follows: one is to adjust the magnitude of the common voltage VCOM of the liquid crystal display panel via a variable resistor; the other is to adjust the common voltage VCOM via an Inter-Integrated Circuit (I2C) interface.

Both of the two methods can obtain an unconspicuous image flicker of the liquid crystal display panel when displaying a flickering image to an extent that it is acceptable by human eyes, and thus improves a user's visual experience. However, when some specific images (images having the same pixel structure as the flickering image) are displayed, human eyes can still perceive the image flicker.

In order that the image flicker cannot be perceived by human eyes when the specific images are displayed, some panel manufacturers employ a timing controller (TCON) to monitor the pixel structures of the flickering images, and allow the image flicker in these specific images to hardly be perceived by human eyes by directly changing the deflection manner of the liquid crystal molecules via some TCON settings.

Such a method has the following disadvantage: as for a deflected pixel structure, its corresponding VCOM might still deviate from an ideal state, and the VCOM should be further adjusted. However, in a case of the flickering image during the mass production stage, changing the deflection manner of the liquid crystal molecules causes the flickering images not to be seen by human eyes, and thus an operator cannot perform regulation. That is to say, the display quality of images is not improved in essence, and is even deteriorated when some normal images are being displayed.

SUMMARY

The present disclosure aims to solve at least one of the technical problems in the prior art, and provides a method for adjusting a display panel, a device for adjusting a display panel, and a display device including the device which can avoid the image flicker from occurring and improve the display quality of images in essence.

According to an aspect of the present disclosure, provided is a method for adjusting a display panel including steps of: detecting an image displayed by a display panel to determine whether the displayed image is a flickering image; inverting original polarities of data voltages inputted onto at least partial data lines of the display panel when it is detected that the displayed image is the flickering image; scanning an I2C interface, and determining whether a common voltage is written; and restoring the polarities of the data voltages on the at least partial data lines to the original polarities when it is determined that the common voltage is written via the I2C interface.

According to an embodiment of the present disclosure, the step of detecting the image displayed by the display panel may include: detecting pixel structures of the display panel to determine whether the displayed image is the flickering image.

According to an embodiment of the present disclosure, the step of detecting the pixel structures of the display panel may include: detecting whether a flickering pixel structure corresponding to a prestored flickering image is present in the pixel structures of the display panel; calculating a ratio of a number of the detected flickering pixel structure to a number of all pixel structures of the display panel and determining whether the ratio is in a preset range, when the flickering pixel structure is present; and determining that the displayed image is the flickering image when the ratio is in the preset range.

According to an embodiment of the present disclosure, the preset range may be set as that the ratio is larger than 50%.

According to an embodiment of the present disclosure, the step of inverting the original polarities of the data voltages inputted onto the at least partial data lines of the display panel may include: inverting the original polarities of the data voltages by changing one or more of a parameter value of POL, a parameter value of SQINV and a parameter value of H2POL.

According to another aspect of the present disclosure, provided is a device for adjusting a display panel including: a detecting circuit for detecting an image displayed by a display panel to determine whether the displayed image is a flickering image; an inverting circuit for inverting original polarities of data voltages inputted onto at least partial data lines of the display panel when it is detected that the displayed image is the flickering image; a scanning circuit for scanning an I2C interface, and determining whether a common voltage is written; and a controller circuit for restoring the polarities of the data voltages on the at least partial data lines to the original polarities when it is determined that the common voltage is written via the I2C interface.

According to an embodiment of the present disclosure, the detecting circuit may detect pixel structures of the display panel to determine whether the displayed image is the flickering image.

According to an embodiment of the present disclosure, the detecting circuit may include: a detecting sub-circuit for detecting whether a flickering pixel structure corresponding to a prestored flickering image is present in the pixel structures of the display panel; a calculating sub-circuit for calculating a ratio of a number of the detected flickering pixel structure to a number of all pixel structures of the display panel, when the detecting sub-circuit detects that the flickering pixel structure is present; and a determining sub-circuit for determining whether the ratio is in a preset range, wherein it is determined that the displayed image is the flickering image when the ratio is in the preset range.

According to an embodiment of the present disclosure, the inverting circuit may invert the original polarities of the data voltages by changing one or more of a parameter value of POL, a parameter value of SQINV and a parameter value of H2POL.

According to another aspect of the present disclosure, provided is a display device including a display panel and the device for adjusting a display panel according to the present disclosure.

When a display panel is adjusted through the method for adjusting a display panel and the device for adjusting a display panel according to the present disclosure, on one hand, in a case that adjusting the image flicker is required while improving the display quality of the image is not required, the original polarities of the data voltages may be changed to change the deflection manner of the liquid crystal molecules so that the image flicker is hardly perceived by human eyes when some special images are displayed by the liquid crystal display panel; on the other hand, in a case that adjusting the image flicker (for example, adjusting VCOM) is required so as to improve the display quality of the image, the polarities of the data voltages may be restored to their original polarities so as to restore the changed deflection manner of the liquid crystal molecules, so that an operator can regulate the image flicker and thus the image quality can be improved in essence.

BRIEF DESCRIPTION OF THE FIGURES

Drawings, which constitute a part of the description, are provided to explain the present disclosure in conjunction with the following specific implementations so as to provide a further understanding, instead of a limitation, of the present disclosure. In the drawings.

DETAILED DESCRIPTION

The present disclosure will be described in detail below in conjunction with the drawings and specific implementations in order that a person skilled in the art can understand the technical solutions of the present disclosure better.

Figure 1:
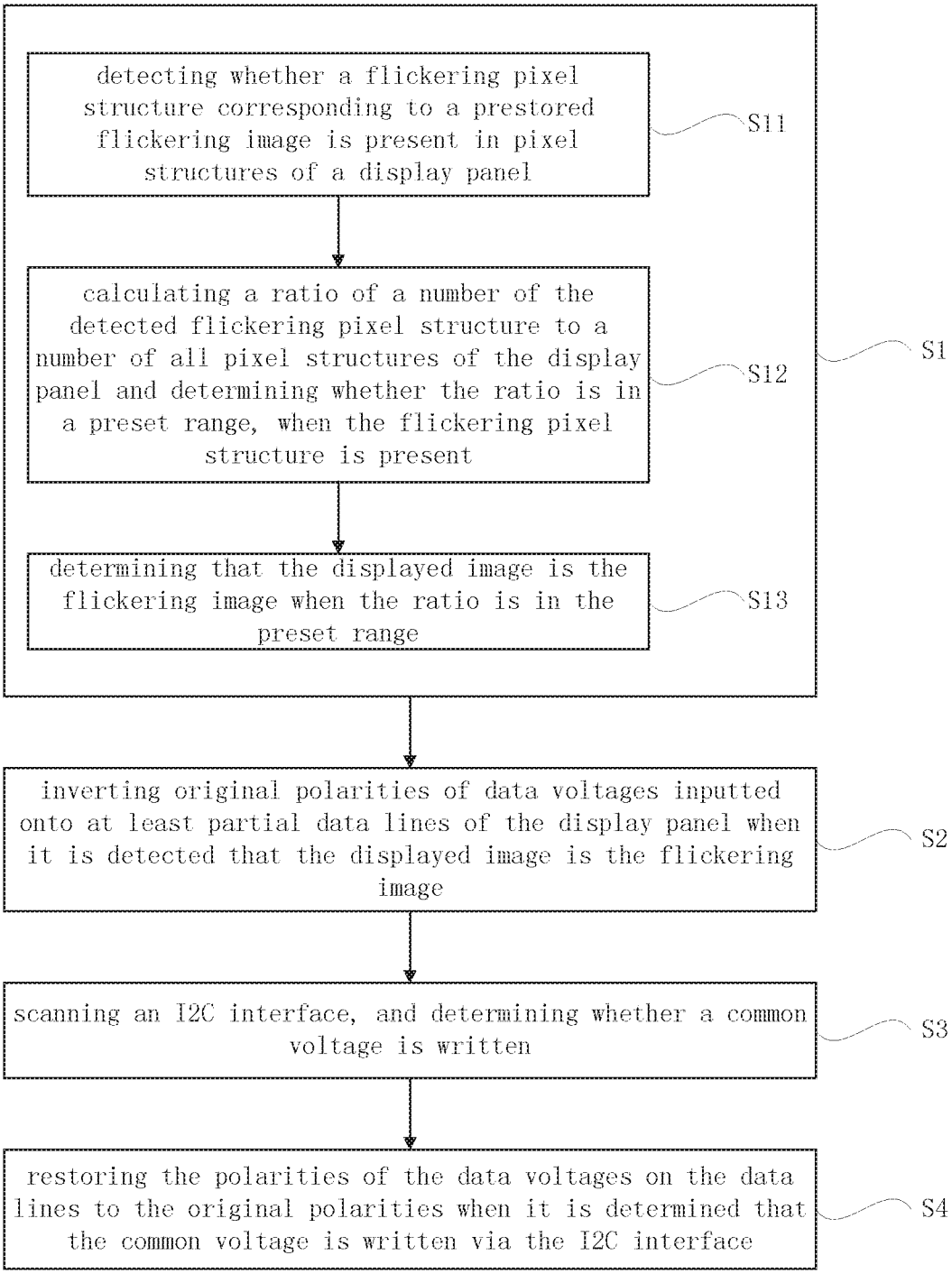
FIG. 1 is a flow chart illustrating a method for adjusting a display panel according to an embodiment of the present disclosure.

FIG. 1 is a flow chart illustrating a method for adjusting a display panel according to an embodiment of the present disclosure.

Referred to FIG. 1, a method for adjusting a display panel according to an embodiment of the present disclosure includes the following Steps S1 to S4.

At Step S1, detecting an image displayed by a display panel to determine whether the displayed image is a flickering image.

According to an embodiment of the present disclosure, Step S1 may include detecting a pixel structure of the display panel to determine whether the displayed image is the flickering image, and may specifically include the following Steps S11 to S13.

At Step S11, detecting whether a flickering pixel structure corresponding to a prestored flickering image is present in pixel structures of the display panel.

Figure 2:
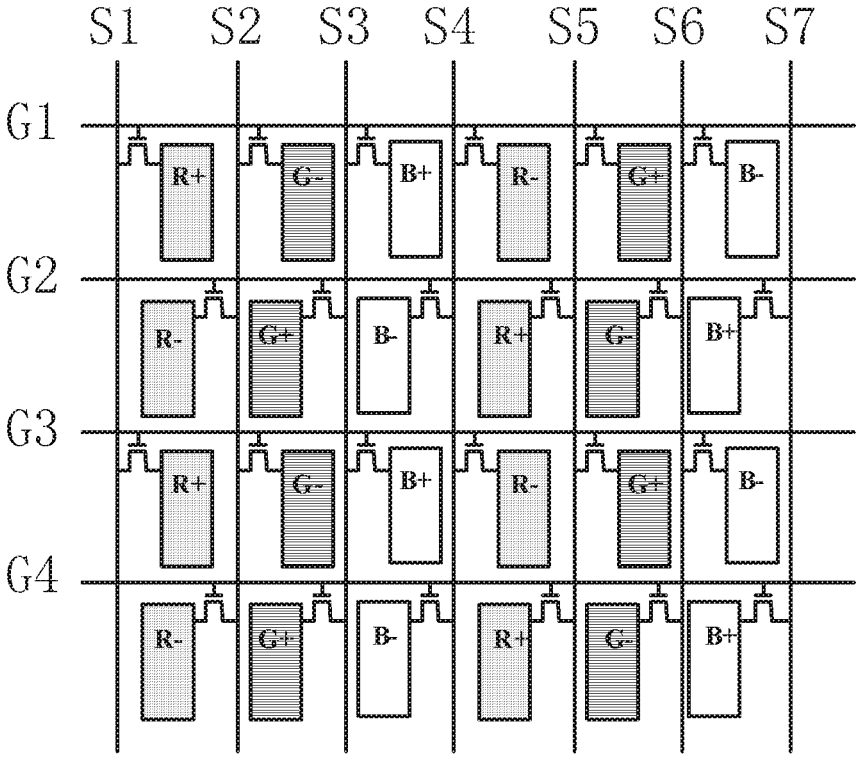
FIG. 2 is a schematic diagram of a pixel structure of a display panel according to an embodiment of the present disclosure.

FIG. 2 is a schematic diagram of a pixel structure of a display panel according to an embodiment of the present disclosure.

In the context of the present disclosure, the term "pixel structure" represents a structure formed by connecting pixels (or sub-pixels) of the display panel to respective gate lines and data lines. Referred to FIG. 2, gate lines G1 to G4 extend in a horizontal direction and control gates of TFTs provided in respective sub-pixels (e.g., red sub-pixels, green sub-pixels and blue sub-pixels). Data lines S1 to S7 extend in a vertical direction and are connected to sources of TFTs provided in the respective sub-pixels, respectively. FIG. 2 shows a pixel structure of a display panel which is, for example, a Column+Z pixel structure, that is, each of the gate lines controls one row of sub-pixels, at odd-numbered rows, the data line is connected to the sources of TFTs provided on the right side thereof, and at even-numbered rows, the data line is connected to the sources of TFTs provided on the left side thereof, and TFTs in the sub-pixels are arranged in a zigzag pattern in a column direction with respect to the data lines. However, the concept of the present disclosure is not limited to this, and other arrangements and/or connection modes may also be used.

Figure 3:
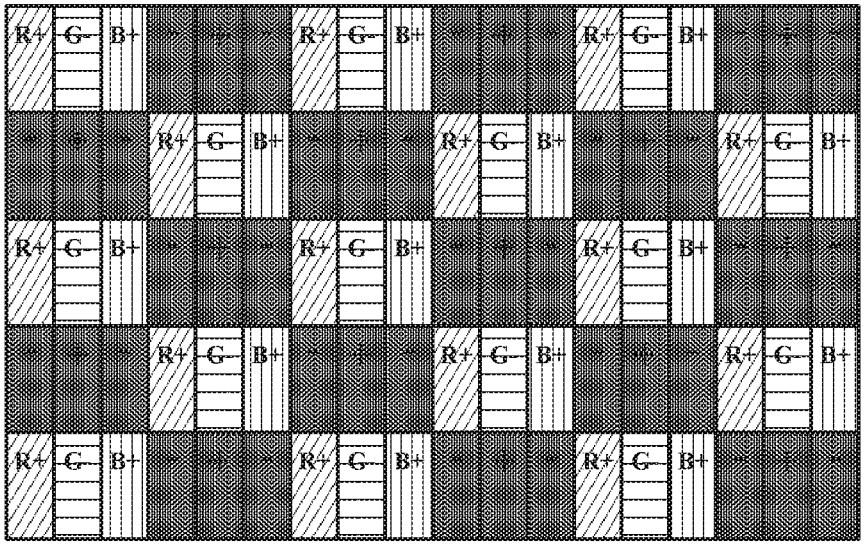
FIG. 3 is a schematic diagram of a flickering pixel structure of the display panel of FIG. 2 when a flickering image is displayed.

FIG. 3 is a flickering pixel structure of the display panel of FIG. 2 when a flickering image is displayed.

In the context of the present disclosure, the term "flickering pixel structure" represents a structural pattern formed by the displayed contents of the pixels (or the sub-pixels) of the display panel when a flickering image is displayed. In a case of the Column+Z pixel structure as shown in FIG. 2, a pixel Skip 1DOT pattern or a sub-pixel Skip 1DOT pattern is typically used as the flickering image. As shown in FIG. 3, adjacent pixels in each row have opposite polarities, and also, adjacent pixels in each column have opposite polarities. That is, the adjacent data lines have opposite polarities. Furthermore, in a same row, one pixel in two adjacent pixels displays with a normal color (e.g., red (R), green (G) and blue (B)) while the other pixel in the two adjacent pixels displays with gray or back; and in a same column, one pixel in two adjacent pixels displays with a normal color while the other pixel in the two adjacent pixels displays with gray or back. However, the flickering pixel structure of the concept of the present disclosure is not limited to this. The method for adjusting the display panel according to the present disclosure may detect all pixel structures of the display panel to detect whether the flickering pixel structure(s) as mentioned above is/are present in the pixel structures of the display panel. The flickering image corresponding to the flickering pixel structure may be prestored. Furthermore, corresponding flickering images may be prestored for different pixel structures of the display panel.

At Step S12, calculating a ratio of a number of the detected flickering pixel structure to a number of all the pixel structures of the display panel and determining whether the ratio is in a preset range, when the flickering pixel structure(s) is/are present. That is, after it is detected that the flickering pixel structure(s) is/are present in the pixel structures of the display panel, a ratio of the area of the flickering image corresponding to the flickering pixel structure(s) to the area of the image displayed by the display panel is calculated first, and then it is determined whether this ratio is in the preset range.

The preset range may be set as that the ratio of the number of the detected flickering pixel structure(s) to the number of all pixel structures of the display panel is larger than 50%. However, the concept of the present disclosure is not limited to this, and the preset range may be set according to the practical circumstances.

At Step S13, determining that the displayed image is the flickering image when the ratio is in the preset range.

That is to say, in the present embodiment, when the ratio of the area of the flickering image corresponding to the flickering pixel structure(s) to the area of the image displayed by the display panel is larger than 50%, it is determined that the image displayed by the display panel is a flickering image as a whole.

At Step S2, inverting original polarities of data voltages inputted onto at least partial data lines of the display panel when it is detected that the displayed image is the flickering image.

It should be noted that, the original polarities of the data voltages as mentioned in the present embodiment refer to the polarities of the data voltages inputted onto the data lines by a data line controlling IC when the display panel starts to display. When the image displayed by the display panel is the flickering image, by inverting the original polarities of the data voltages on the data lines, the deflection manner of the liquid crystal molecules corresponding to the pixels controlled by the data lines may be changed, allowing the image flicker not to be seen by human eyes.

Inverting the original polarities of the data voltages inputted onto the at least partial data lines of the display panel may include inverting the original polarities of the data voltages by changing one or more of a parameter value of POL, a parameter value of SQINV and a parameter value of H2POL.

It should be noted that, POL (polarity inverting input) refers to a horizontal polarity control signal, that is, for directly controlling the polarity of a data line. SQINV (square inversion) is for selecting the inversion manner of POL in the horizontal direction. In a case that SQINV is "H", the horizontal inversion manner is 2-dot inversion. In a case that SQINV is "L", the horizontal inversion manner is 1-dot inversion. H2POL (polarity control) is for controlling whether to inverse POL. In a case that H2POL is "L", POL is inverted; in a case that H2POL is "H", POL is no inverted. It should be noted that, when the polarities of the data lines are controlled by changing the parameter value of POL, the original polarities of the data voltages of all the data lines are inverted; when the polarities of the data lines are controlled by changing the parameter value of SQINV or H2POL, not all the data lines have the original polarities of their data voltages inverted.

Taking the pixel structure of the display panel as shown in FIG. 2 as an example, by changing one or more of a parameter value of POL, a parameter value of SQINV and a parameter value of H2POL, the inverted polarities of the data voltages are specifically shown in the following table 1.

TABLE 1

| POL | SQINV | H2POL | S1 | S2 | S3 | S4 | S5 | ... |
|---|---|---|---|---|---|---|---|---|
| L | L | L | − | + | − | + | − | ... |
| H | L | L | + | − | + | − | + | ... |
| L | H | L | − | + | + | − | − | ... |
| L | L | H | + | − | + | − | + | ... |
| H | H | L | + | − | − | + | + | ... |
| H | L | H | − | + | − | + | − | ... |
| L | H | H | + | − | − | + | + | ... |
| H | H | H | − | + | + | − | − | ... |

Figure 4:
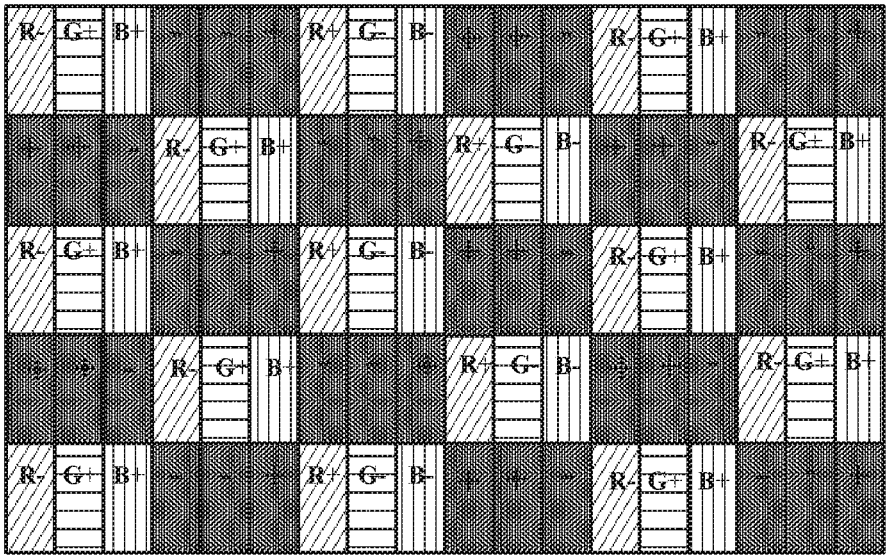
FIG. 4 is a schematic diagram of a pixel structure of the flickering pixel structure of FIG. 3 after polarities are inverted.

If S1 is "+", it means that the polarities of all the pixels (or sub-pixels) connected to the data line S1 are positive; if S1 is "−", it means that the polarities of all the pixels (or sub-pixels) connected to the data line S1 are negative, and so on. In addition, if a parameter value is "L", it means that the original value is maintained, i.e., there is no action; if a parameter value is "H", it means that an action, i.e. an inversion, will be done. For example, according to an inversion manner shown in table 1 in which POL is "L", SQINV is "H" and H2POL is "L", the flickering pixel structure as shown in FIG. 3 has its polarities inverted and the flickering pixel structure with inverted polarities is shown in FIG. 4.

At Step S3, scanning an I2C interface, and determining whether a common voltage is written.

In order to adjust the non-ideal common voltage of the display panel, an operator writes an adjusted common voltage via the I2C interface. Therefore, if the common voltage is being written, it means that it is required to adjust the common voltage of the display panel.

At Step S4, restoring the polarities of the data voltages on the data lines to the original polarities when it is determined that the common voltage is written via the I2C interface.

When it is determined that the common voltage is written via the I2C interface, the polarities of the data voltages as inverted in Step S2 are inverted once again to restore to their original polarities, and thereby the image flicker will be seen again by human eyes. The common voltage deviating from the ideal state can be adjusted by the common voltage written via the I2C interface so as to make it approximate or equal to the ideal common voltage, and thus the display quality of the image is improved in essence.

In the method for adjusting a display panel according to the present disclosure, on one hand, in a case that adjusting the image flicker is required while improving the display quality of the image is not required, the original polarities of the data voltages may be changed to change the deflection manner of the liquid crystal molecules so that the flicker is hardly seen by human eyes when some special images are displayed by the liquid crystal display panel; on the other hand, in a case that adjusting the image flicker is required so as to improve the display quality of the image, the polarities of the data voltages may be restored to their original polarities so as to restore the changed deflection manner of the liquid crystal molecules, so that an operator can seen the image flicker and regulate the flickering image, and thus the image quality can be improved in essence.

Figure 5:
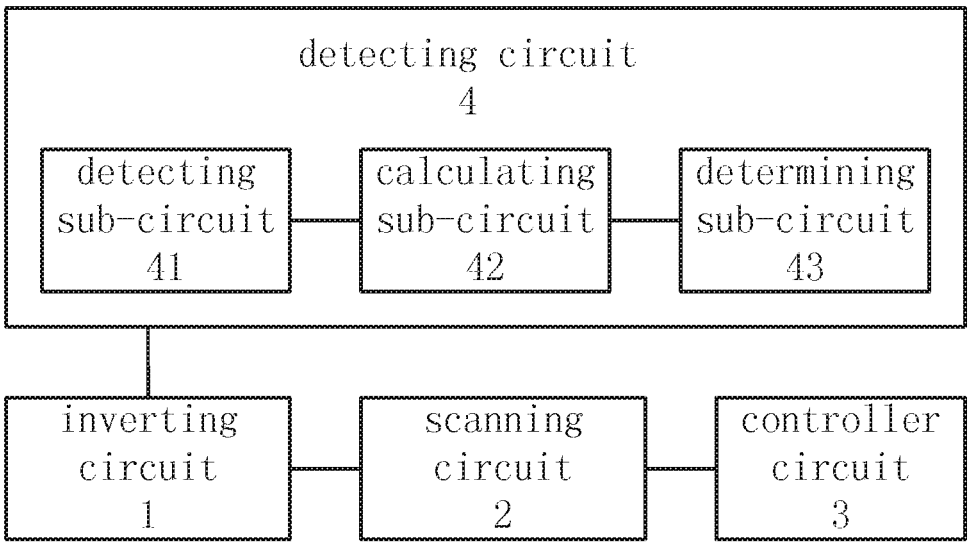
FIG. 5 is a schematic diagram of a structure of a device for adjusting a display panel according to an embodiment of the present disclosure.

FIG. 5 is a schematic diagram of a structure of a device for adjusting a display panel according to an embodiment of the present disclosure.

Referred to FIG. 5, the device for adjusting a display panel according to an embodiment of the present disclosure may include an inverting circuit 1, a scanning circuit 2, a controller circuit 3 and a detecting circuit 4. The detecting circuit 4 is used for detecting an image displayed by a display panel to determine whether the displayed image is a flickering image. When it is detected that the displayed image is the flickering image, the inverting circuit 1 inverts the original polarities of the data voltages inputted onto at least partial data lines of the display panel. The scanning circuit 2 is used for scanning an I2C interface, and determining whether a common voltage is written. When it is determined that the common voltage is written via the I2C interface, the controller circuit 3 restores the polarities of the data voltages on the at least partial data lines to the original polarities.

According to an embodiment of the present disclosure, the detecting circuit 4 may detect the pixel structures of the display panel to determine whether the displayed image is the flickering image. As shown in FIG. 5, the detecting circuit 4 may includes a detecting sub-circuit 41, a calculating sub-circuit 42 and a determining sub-circuit 43. The detecting sub-circuit 41 is used for detecting whether a flickering pixel structure corresponding to a prestored flickering image is present in the pixel structures of the display panel. When the detecting sub-circuit 41 detects that the flickering pixel structure is present, the calculating sub-circuit 42 calculates a ratio of the number of the flickering pixel structure(s) to the number of all pixel structures of the display panel. The determining sub-circuit 43 is used for determining whether the ratio is in a preset range. If the ratio is in the preset range, it may be determined that the displayed image is the flickering image.

According to an embodiment of the present disclosure, the inverting circuit 1 may invert the original polarities of the data voltages by changing one or more of a parameter value of POL, a parameter value of SQINV and a parameter value of H2POL.

It should be appreciated that the circuits and the sub-circuit modules or steps in the present disclosure may be implemented by a general-purpose computing device, may be integrated in a single computing device, or distributed on a network composed of a plurality of computing devices; optionally, they may be implemented by computer-executable program code, and thus may be stored in a storage device so as to be executed by a computing device. In some cases, the illustrated or described steps may be performed in a sequence different from that as described herein, or may be made into respective integrated circuit modules, respectively, or several modules or steps may be implemented by making them into a single integrated circuit module. Thus, the present disclosure is not limited to any specific combination of hardware and software.

According to an embodiment of the present disclosure, a display device is further provided, and includes a display panel and the device for adjusting the display panel according to the present disclosure.

It will be appreciated that the above implementations are only exemplary implementations for illustrating the principle of the disclosure, and the present disclosure is not limited to them. An ordinary person skilled in the art may make various modifications and improvements without departing from the spirit and essence of the present disclosure. These modifications and the improvements should be considered as the protective scope of the present disclosure.

What is claimed is:

1. A method for adjusting a display panel, comprising steps of:

detecting an image displayed by a display panel to determine whether the displayed image is a flickering image;

inverting original polarities of data voltages inputted onto at least partial data lines of the display panel when it is detected that the displayed image is the flickering image;

scanning an I2C interface, and determining whether a common voltage is written; and restoring the polarities of the data voltages on the at least partial data lines to the original polarities when it is determined that the common voltage is written via the I2C interface.

2. The method of claim 1, wherein the step of detecting the image displayed by the display panel comprises:

detecting pixel structures of the display panel to determine whether the displayed image is the flickering image.

3. The method of claim 2, wherein the step of detecting the pixel structures of the display panel comprises:

detecting whether a flickering pixel structure corresponding to a prestored flickering image is present in the pixel structures of the display panel;

calculating a ratio of a number of the detected flickering pixel structure to a number of all pixel structures of the display panel and determining whether the ratio is in a preset range, when the flickering pixel structure is present; and determining that the displayed image is the flickering image when the ratio is in the preset range.

4. The method of claim 3, wherein the preset range is set as that the ratio is larger than 50%.

5. The method of claim 1, wherein the step of inverting the original polarities of the data voltages inputted onto the at least partial data lines of the display panel comprises:

inverting the original polarities of the data voltages by changing one or more of a parameter value of POL, a parameter value of SQINV and a parameter value of H2POL.

6. A device for adjusting a display panel, comprising a memory having a computer program stored thereon and a processor configured to execute the computer program to perform steps of:

detecting an image displayed by a display panel to determine whether the displayed image is a flickering image;

inverting original polarities of data voltages inputted onto at least partial data lines of the display panel when it is detected that the displayed image is the flickering image;

scanning an I2C interface, and determining whether a common voltage is written; and restoring the polarities of the data voltages on the at least partial data lines to the original polarities when it is determined that the common voltage is written via the I2C interface.

7. The device of claim 6, wherein the processor is configured to execute the computer program to perform the step of detecting the image by:

detecting pixel structures of the display panel to determine whether the displayed image is the flickering image.

8. The device of claim 7, wherein the processor is configured to execute the computer program to perform the step of detecting the pixel structures of the display panel by:

detecting whether a flickering pixel structure corresponding to a prestored flickering image is present in the pixel structures of the display panel;

calculating a ratio of a number of the detected flickering pixel structure to a number of all pixel structures of the display panel and determining whether the ratio is in a preset range, when the flickering pixel structure is present; and determining that the displayed image is the flickering image when the ratio is in the preset range.

9. The device of claim 8, wherein the preset range is set as that the ratio is larger than 50%.

10. The device of claim 6, wherein the processor is configured to execute the computer program to perform the step of inverting the original polarities of the data voltages inputted onto the at least partial data lines of the display panel by:

inverting the original polarities of the data voltages by changing one or more of a parameter value of POL, a parameter value of SQINV and a parameter value of H2POL.

11. A display device comprising a display panel and the device for adjusting the display panel of claim 6.

* * * * *